US005386691A

United States Patent [19]

Bonaquist et al.

[11] Patent Number: 5,386,691

[45] Date of Patent: Feb. 7, 1995

[54] CRYOGENIC AIR SEPARATION SYSTEM WITH KETTLE VAPOR BYPASS

[75] Inventors: Dante P. Bonaquist, Grand Island; Robert A. Beddome, Tonawanda; Michael J. Lockett, Grand Island, all of N.Y.

[73] Assignee: Praxair Technology, Inc., Danbury, Conn.

[21] Appl. No.: 181,150

[22] Filed: Jan. 12, 1994

[51] Int. Cl.[6] ..... F25J 3/02

[52] U.S. Cl. ..... 62/25; 62/22; 62/38

[58] Field of Search ..... 62/25, 22, 38

[56] References Cited

U.S. PATENT DOCUMENTS

| | | | |
|---|---|---|---|
| 5,078,766 | 1/1992 | Guilleminot | 62/22 |
| 5,079,923 | 1/1992 | Grenier | 62/22 |
| 5,098,456 | 3/1992 | Dray et al. | 62/24 |
| 5,108,476 | 4/1992 | Dray et al. | 62/24 |
| 5,114,452 | 5/1992 | Dray | 62/24 |
| 5,197,296 | 3/1993 | Prosser et al. | 62/22 |
| 5,228,296 | 7/1993 | Howard | 62/22 |
| 5,263,327 | 11/1993 | Drnevich et al. | 62/24 |
| 5,265,429 | 11/1993 | Dray | 62/41 |
| 5,305,611 | 4/1994 | Howard | 62/22 |
| 5,337,570 | 8/1994 | Prosser | 62/25 |

*Primary Examiner*—Ronald C. Capossela
*Attorney, Agent, or Firm*—Stanley Ktorides

[57] ABSTRACT

A cryogenic air separation system wherein a portion of the feed air is condensed against vaporizing product from the air separation plant and at least some of the vaporized bottom liquid from the higher pressure column is withdrawn from the system, bypassing the lower pressure column thereby increasing the L/V ratio in the upper portion of the lower pressure column to compensate for reduced liquid in that column caused by the feed air liquefaction.

6 Claims, 1 Drawing Sheet

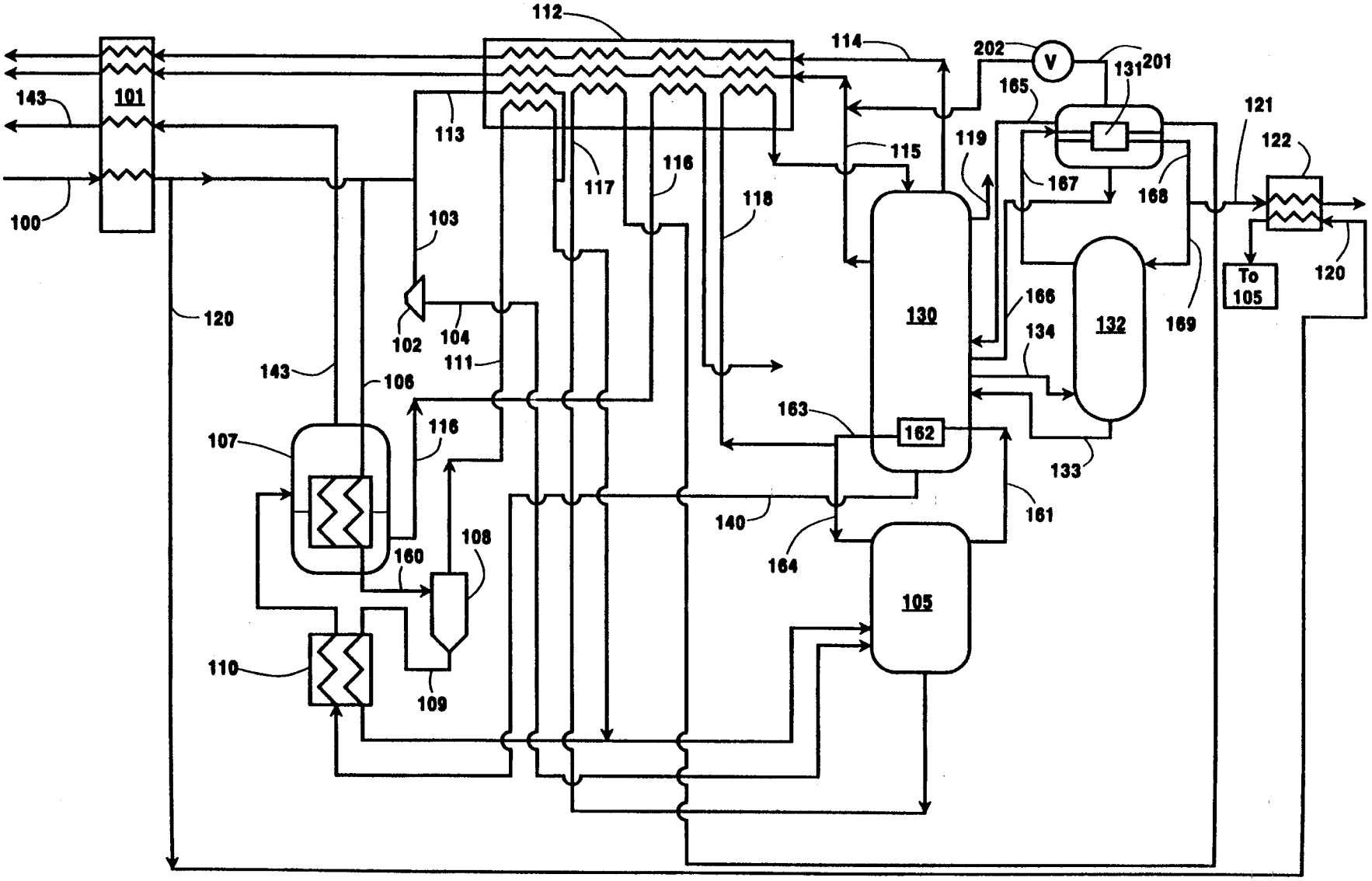
To 105
V
100
101
102
103
104
105
106
107
108
109
110
111
112
113
114
115
116
117
118
119
120
121
122
130
131
132
133
134
140
143
160
161
162
163
164
165
166
167
168
169
201
202

CRYOGENIC AIR SEPARATION SYSTEM WITH KETTLE VAPOR BYPASS

TECHNICAL FIELD

This invention relates generally to cryogenic air separation and more particularly to the production of elevated pressure product gas from the air separation.

BACKGROUND ART

An often used commercial system for the separation of air is cryogenic rectification. The separation is driven by elevated feed pressure which is generally attained by compressing feed air in a compressor prior to introduction into a column system. The separation is carried out by passing liquid and vapor in countercurrent contact through the column or columns on vapor liquid contacting elements whereby more volatile component(s) are passed from the liquid to the vapor, and less volatile component(s) are passed from the vapor to the liquid. As the vapor progresses up a column it becomes progressively richer in the more volatile components and as the liquid progresses down a column it becomes progressively richer in the less volatile components. Generally the cryogenic separation is carried out in a main column system comprising at least one column wherein the feed is separated into nitrogen-rich and oxygen-rich components, and in an auxiliary argon column wherein feed from the main column system is separated into argon-richer and oxygen-richer components.

Often it is desired to recover the product gas from the air separation system at an elevated pressure. Generally this is carried out by compressing the product gas to a higher pressure by passage through a compressor. Such a system is effective but is quite costly.

In response to this problem there have been developed air separation processes wherein liquid oxygen is pressurized, such as by pumping or by hydrostatic means, and vaporized against an air stream which is either partially or totally condensed. This markedly reduces the compression costs for the elevated pressure oxygen gas product.

One problem with such systems is that all of the condensed air enters the high pressure column of the air separation plant near the bottom of the column. The condensed air undergoes practically no distillation compared to air entering as a vapor at the bottom of the high pressure column. As a result, nitrogen, which is usually available as liquid nitrogen reflux for operation of the high pressure column and the top portion of the low pressure column when all air enters the high pressure column as a vapor, is not separated from the liquid air. Since the reflux ratio of the high pressure column is fixed by the purity of reflux withdrawn from the top of the column and the number of equilibrium stages present in the column, there is produced less reflux for operation of the top portion of the upper column. Because of this, the recovery of argon will be less than for a comparable process where oxygen is withdrawn as a vapor from the bottom of the low pressure column. Further, if any of the nitrogen separated is recovered as a liquid, the reflux available to the top portion of the upper column will be even less. In fact, it is possible through the production of a sufficient quantity of liquid nitrogen to reduce the quantity of reflux to below a point known as minimum reflux where the L/V ratio in the top portion of the upper column is not sufficient to achieve the desired product purity at any recovery level.

Accordingly it is an object of this invention to provide a system for the separation of feed air by cryogenic rectification wherein elevated pressure oxygen gas may be produced by vaporizing liquid oxygen against condensing feed air and wherein the upper column or lower pressure column of the air separation plant may be operated with an improved liquid to vapor (L/V) ratio to improve the degree of separation in the lower pressure column.

SUMMARY OF THE INVENTION

The above and other objects which will become apparent to one skilled in the art upon a reading of this disclosure are attained by the present invention, one aspect of which is:

A method for the separation of feed air by cryogenic rectification comprising:

(A) condensing feed air and introducing the liquefied feed air into a first column operating at a pressure within the range of from 60 to 200 psia;

(B) separating feed air by cryogenic rectification within said first column into nitrogen-enriched fluid and oxygen-enriched liquid, and passing nitrogen-enriched fluid into a second column operating at a pressure less than that of said first column;

(C) partially vaporizing oxygen-enriched liquid to produce oxygen-enriched vapor and remaining oxygen-enriched liquid, and passing remaining oxygen-enriched liquid into the second column;

(D) separating the fluids passed into the second column by cryogenic rectification into nitrogen-rich vapor and oxygen-rich liquid;

(E) vaporizing oxygen-rich liquid by indirect heat exchange with feed air to carry out the condensation of step (A);

(F) recovering vapor resulting from the heat exchange of step (E) as product oxygen gas; and (G) removing at least some of the oxygen-enriched vapor produced as a result of the partial vaporization of step (C) without passing it into the second column.

Another aspect of the invention comprises:

Apparatus for the separation of feed air by cryogenic rectification comprising:

(A) an air separation plant comprising a first column and a second column;

(B) a product boiler, means for passing feed air to the product boiler and means for passing feed air from the product boiler into the first column;

(C) an argon column condenser, means for passing fluid from the first column to the argon column condenser and means for passing fluid from the argon column condenser into the second column;

(D) means for passing fluid from the second column to the product boiler;

(E) means for recovering product gas from the product boiler; and (F) means for withdrawing vapor from the argon column condenser and removing said vapor without passing it into the second column.

As used herein, the term "column" means a distillation or fractionation column or zone, i.e. a contacting column or zone wherein liquid and vapor phases are countercurrently contacted to effect separation of a fluid mixture, as for example, by contacting of the vapor and liquid phases on a series of vertically spaced trays or plates mounted within the column and/or on packing elements which may be structured packing and/or random packing elements. For a further discussion of distillation columns, see the Chemical Engineers' Handbook fifth edition, edited by R. H. Perry and C. H. Chilton, McGraw-Hill Book Company, New York, Section 13, *The Continuous Distillation Process.* The term, double column is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluid streams into heat exchange relation without any physical contact or intermixing of the fluids with each other.

As used herein, the term "argon column" means a column which processes a feed comprising argon and produces a product having an argon concentration which exceeds that of the feed and which may include a heat exchanger or a top condenser in its upper portion.

As used herein, the term "liquid oxygen" means a liquid having an oxygen concentration of at least 50 mole percent.

As used herein the term "liquid nitrogen" means a liquid having a nitrogen concentration of at least 85 mole percent.

As used herein the term "air separation plant" means a facility wherein feed air is separated by cryogenic rectification, comprising at least one column and attendant interconnecting equipment such as pumps, piping, valves and heat exchangers.

As used herein the term "feed air" means a fluid comprising primarily oxygen, nitrogen and argon, such as air.

BRIEF DESCRIPTION OF THE DRAWING

The sole Figure is a schematic representation of one particularly preferred embodiment of the cryogenic rectification system of the invention.

DETAILED DESCRIPTION

The present invention provides a means to compensate for the reduction in reflux available to the top portion of the lower pressure column inherent in a liquid feed air process especially with the production of liquid nitrogen, by decreasing the quantity of vapor rising in the top portion of the lower pressure column. The degree of separation which can be obtained in the top portion of the lower pressure column is governed by the ratio of liquid descending to vapor rising otherwise known as the L/V ratio. The invention provides a way of reducing V in order to compensate for a reduction in L due to the condensation of air in the product boiler and also due to the production of liquid nitrogen. In general the invention comprises the addition of a vapor phase line between the argon column condenser and the waste stream withdrawn from the lower pressure column to permit a portion of the high pressure column kettle stream which is vaporized in the argon column condenser to bypass the top portion of the upper column thereby reducing V and increasing L/V in the top portion of the lower pressure column and thus moving its operation away from the minimum reflux condition.

The invention will be described in detail with reference to the Drawing which illustrates one particularly preferred embodiment of the invention wherein a portion of the feed air is condensed against vaporizing liquid oxygen in the product boiler and another portion of the feed air is turboexpanded to generate refrigeration.

Referring now to the Figure, feed air 100 which has been compressed to a pressure generally within the range of from 90 to 500 pounds per square inch absolute (psia) is cooled by indirect heat exchange against return streams by passage through heat exchanger 101. A first portion 103 of the cooled, compressed feed air is provided to turboexpander 102 and turboexpanded to a pressure generally within the range of from 60 to 200 psia. The resulting turboexpanded air 104 is introduced into first column 105 which is operating at a pressure generally within the range of from 60 to 200 psia. Generally portion 103 will comprise from 65 to 90 percent of feed air 100.

A second portion 106 of the cooled, compressed feed air is provided to product boiler 107 wherein it is at least partially condensed by indirect heat exchange with vaporizing oxygen-rich liquid taken from the air separation plant as will be more fully discussed later. Generally second portion 106 comprises from 5 to 35 percent of feed air 100. Resulting liquid is introduced into column 105 at a point above the vapor feed. In the case where stream 106 is only partially condensed, resulting stream 160 may be passed directly into column 105 or may be passed, as shown in the Figure, to separator 108. Liquid 109 from separator 108 is then passed into column 105. Liquid 109 may be further cooled by passage through heat exchanger 110 prior to being passed into column 105. Cooling the condensed portion of the feed air improves liquid production from the process.

Vapor 111 from separator 108 may be passed directly into column 105 or may be cooled or condensed in heat exchanger 112 against return streams and then passed into column 105. Furthermore, a fourth portion 113 of the cooled compressed feed air may be cooled or condensed in heat exchanger 112 against return streams and then passed into column 105. Streams 111 and 113 can be utilized to adjust the temperature of the feed air fraction 103 that is turboexpanded. For example, increasing stream 113 will increase warming of the return streams in heat exchanger 112 and thereby the temperature of stream 103 will be increased. The higher inlet temperature to turboexpander 102 can increase the developed refrigeration and can control the exhaust temperature of the expanded air to avoid any liquid content. A third portion 120 of the cooled compressed feed air may be further cooled or condensed by indirect heat exchange, such as in heat exchanger 122, with fluid produced in the argon column and then passed into column 105.

Within first column 105 the feeds are separated by cryogenic rectification into nitrogen-enriched and oxygen-enriched fluids. In the embodiment illustrated in the Figure, the first column is the higher pressure column of a double column system. Nitrogen-enriched vapor 161 is withdrawn from column 105 and condensed in reboiler 162 against boiling column 130 bottoms. Resulting liquid 163 is divided into stream 164 which is returned to column 105 as liquid reflux, and into stream 118 which is subcooled in heat exchanger 112 and flashed into second column 130 of the air separation plant. Second column 130 is operating at a pressure less than that of first column 105 and generally within the range of from 10 to 70 psia. Liquid nitrogen product may be recovered from stream 118 before it is flashed into column 130 or, as illustrated in the Figure, may be taken directly out of column 130 as stream 119 to minimize tank flashoff.

Oxygen-enriched liquid or kettle liquid is withdrawn from the lower portion of column 105 as stream 117, subcooled in heat exchanger 112 and passed into argon column condenser 131 which serves to condense argon column top vapor. Remaining oxygen-enriched liquid is then passed from argon column condenser 131 into column 130 in stream 166. Most of the oxygen-enriched vapor resulting from the partial vaporization of the kettle liquid in argon column condenser 131 is passed from condenser 131 into column 130 in stream 165. However, some of the resulting oxygen-enriched vapor is removed from the system by bypassing column 130 as will be discussed more fully later.

Within column 130 the fluids passed into the column are separated by cryogenic rectification into nitrogen-rich vapor and oxygen-rich liquid. Nitrogen-rich vapor is withdrawn from column 130 as stream 114, warmed by passage through heat exchangers 112 and 101 to about ambient temperature and recovered as product nitrogen gas. Nitrogen-rich waste stream 115 is withdrawn from column 130 at a point between the nitrogen-enriched and oxygen-enriched feed stream introduction points, and is warmed by passage through heat exchangers 112 and 101 before being released to the atmosphere. Some portion of waste stream 115 can be utilized to regenerate adsorption beds used to clean the feed air.

A stream comprising primarily oxygen and argon is passed 134 from column 130 into argon column 132 wherein it is separated by cryogenic rectification into oxygen-richer liquid and argon-richer vapor. Oxygen-richer liquid is returned as stream 133 to column 130. Argon-richer vapor is passed 167 to argon column condenser 131 and condensed against partially vaporizing oxygen-enriched liquid to produce argon-richer liquid 168. A portion 169 of argon-richer liquid is employed as liquid reflux for column 132. Another portion 121 of the argon-richer liquid is recovered as crude argon product generally having an argon concentration exceeding 96 percent. As illustrated in FIG. 1, crude argon product stream 121 may be warmed or vaporized in heat exchanger 122 against feed air stream 120 prior to further upgrading and recovery.

The invention is particularly advantageous in obtaining good argon recovery because refrigeration is produced by expanding a portion of the feed air before it enters the high pressure column. This maximizes the liquid feeds to the low pressure column and improves the reflux ratios in that column. Other systems which expand vapor from the high pressure column or air into the low pressure column would have less liquid feed to the low pressure column.

Oxygen-rich liquid 140 is withdrawn from column 130 and pressurized to a pressure greater than that of column 130 by either a change in elevation, i.e. the creation of liquid head as illustrated in the Figure, by pumping, by employing a pressurized storage tank, or by any combination of these methods. The liquid oxygen is then warmed by passage through heat exchanger 110 and passed into product condenser or product boiler 107 where it is at least partially vaporized. Gaseous product oxygen 143 is passed from product boiler 107, warmed through heat exchanger 101 and recovered as product oxygen gas. As used herein the term "recovered" means any treatment of the gas or liquid including venting to the atmosphere. Liquid 116 may be taken from product boiler 107, subcooled by passage through heat exchanger 112 and recovered as product liquid oxygen. Generally the oxygen product will have a purity within the range of from 98 to 99.95 mole percent. Oxygen recoveries of up to 99.9 percent are attainable with the invention.

As mentioned previously, at least some of the oxygen-enriched vapor produced as a result of the partial vaporization of the kettle liquid is withdrawn from argon column condenser 131 as stream 201, passed through valve 202, and removed from the system without passing into lower pressure column 130, i.e. by passing this column. In this way less vapor than in conventional practice is provided into lower pressure column 130 thus increasing the L/V ratio in the upper portion of the lower pressure column, i.e., that portion of the column above the feed point of the oxygen-enriched fluid or fluids from the argon column condenser. This improves the separation efficiency within the lower pressure column by compensating for the reduced liquid within the upper portion of the lower pressure column. Generally stream 201 will have a flowrate up to about 5 percent of the flowrate of feed air stream 100 which is the flowrate of the total feed air introduced into the air separation plant.

The embodiment illustrated in the Figure is a preferred embodiment wherein the kettle vapor bypass fluid is passed in indirect heat exchange with process streams including feed air 100. In this embodiment bypass stream 201 is passed into waste stream 115 and is thus passed through heat exchanger 101 wherein it serves to cool feed air 100 by indirect heat exchange before the feed air is condensed against the vaporizing liquid oxygen in the product boiler. The bypass fluid is then removed from the system upon withdrawal of stream 115 from heat exchanger 101. Generally from about 5 to 30 percent of the kettle liquid passed into the argon column condenser bypasses the lower pressure column in vapor stream 201.

Now by the use of this invention one can operate a cryogenic air separation system employing liquid oxygen vaporization against condensing feed air with improved operating performance over heretofore available such systems. Although the invention has been described in detail with reference to a certain particularly preferred embodiment, those skilled in the art will recognize that there are other embodiments of the invention within the spirit and scope of the claims.

We claim:

1. A method for the separation of feed air by cryogenic rectification comprising:

(A) condensing feed air and introducing the liquefied feed air into a first column operating at a pressure within the range of from 60 to 200 psia;

(B) separating feed air by cryogenic rectification within said first column into nitrogen-enriched fluid and oxygen-enriched liquid, and passing nitrogen-enriched fluid into a second column operating at a pressure less than that of said first column;

(C) partially vaporizing oxygen-enriched liquid to produce oxygen-enriched vapor and remaining oxygen-enriched liquid, and passing remaining oxygen-enriched liquid into the second column;

(D) separating the fluids passed into the second column by cryogenic rectification into nitrogen-rich vapor and oxygen-rich liquid;

(E) vaporizing oxygen-rich liquid by indirect heat exchange with feed air to carry out the condensation of step (A);

(F) recovering vapor resulting from the heat exchange of step (E) as product oxygen gas; and (G) removing at least some of the oxygen-enriched vapor produced as a result of the partial vaporization of step (C) without passing it into the second column.

2. The method of claim 1 wherein the oxygen-enriched vapor of step (G) is passed in indirect heat exchange with feed air to cool the feed air prior to the condensation of the feed air by indirect heat exchange with the oxygen-rich liquid.

3. The method of claim 1 further comprising passing some oxygen-enriched vapor produced as a result of the partial vaporization of step (C) into the second column.

4. The method of claim 1 further comprising recovering liquid nitrogen from the second column.

5. The method of claim 1 further comprising expanding a vapor stream of feed air and passing this expanded stream into the first column.

6. Apparatus for the separation of feed air by cryogenic rectification comprising:

(A) an air separation plant comprising a first column and a second column;

(B) a product boiler, means for passing feed air to the product boiler and means for passing feed air from the product boiler into the first column;

(C) an argon column condenser, means for passing fluid from the first column to the argon column condenser and means for passing fluid from the argon column condenser into the second column;

(D) means for passing fluid from the second column to the product boiler;

(E) means for recovering product gas from the product boiler; and (F) means for withdrawing vapor from the argon column condenser and removing said vapor without passing it into the second column.

* * * * *